US005375760A

United States Patent [19]

Doko

[11] Patent Number: 5,375,760

[45] Date of Patent: Dec. 27, 1994

[54] METHOD OF PRODUCING ALUMINUM ALLOY HEAT-EXCHANGER

[75] Inventor: Takeyoshi Doko, Kiyotakinakayasudo, Japan

[73] Assignee: Furukawa Aluminum Co., Ltd., Tokyo, Japan

[21] Appl. No.: 197,202

[22] Filed: Feb. 16, 1994

Related U.S. Application Data

[63] Continuation of Ser. No. 959,688, Oct. 13, 1992, abandoned.

[30] Foreign Application Priority Data

Oct. 18, 1991 [JP] Japan ..... 3-298098
Oct. 18, 1991 [JP] Japan ..... 3-298099
Mar. 17, 1992 [JP] Japan ..... 4-91783

[51] Int. Cl.[5] ..... B23K 31/02; B23K 101/14

[52] U.S. Cl. ..... 228/183; 228/231; 228/262.51; 148/528

[58] Field of Search ..... 228/183, 231, 262.51; 148/528

[56] References Cited

U.S. PATENT DOCUMENTS

| | | | |
|---|---|---|---|
| 3,489,448 | 1/1970 | Nagara et al. | 29/890.054 |
| 4,214,925 | 7/1980 | Arita et al. | 228/183 |
| 4,626,295 | 12/1986 | Sasaki et al. | 228/231 |
| 4,699,674 | 10/1987 | Finnegan | 148/528 |
| 4,727,001 | 2/1988 | Takemoto et al. | 228/263.17 |

*Primary Examiner*—P. Austin Bradley
*Assistant Examiner*—Jeffrey T. Knapp
*Attorney, Agent, or Firm*—Vineet Kohli

[57] ABSTRACT

A method of producing an aluminum alloy heat-exchanger is disclosed, wherein, upon producing an aluminum alloy heat-exchanger by soldering technique, it is retained for 10 minutes to 30 hours at 400° to 500° C. after finishing a heating for soldering. It is better to retain the heat-exchanger during cooling. Alternatively, the heat-exchanger may be cooled to 150° C. or lower and reheated to 400° to 500° C. for at least 10 minutes to up to 30 hours. Furthermore it is preferable to cool at a cooling velocity of not slower than 30° C./min across a temperature range from about 200° C. to about 400° C. after the retainment. Excellent thermal efficiency, high strength and excellent corrosion resistance can be achieved this way.

15 Claims, 2 Drawing Sheets

METHOD OF PRODUCING ALUMINUM ALLOY HEAT-EXCHANGER

This is a continuation of co-pending application Ser. No. 07/959,688, filed on Oct. 13, 1992, now abandoned.

BACKGROUND OF THE INVENTION

The present invention relates to a method of producing aluminum alloy heat-exchanger. In more detail, it relates to a method of improving the thermal efficiency, strength and corrosion resistance of heat-exchanger produced by soldering technique.

The heat-exchangers such as radiator used for cars etc. have a structure, wherein, for example, as shown in FIG. 1, thin-wall fins (2) machined into corrugated shape are formed unitedly between a plurality of flat tubes (1) and both ends of these flat tubes (1) are opened respectively toward spaces constituted with header (3) arid tank (4). A high-temperature refrigerant is fed from the space on the side of one tank to the space on the side of other tank (4) through the flat tubes (1) and the refrigerant having become low temperature through the heat-exchange at the portions of tube (1) and fin (2) is circulated again to the external portion.

The materials of the tube and header of such heat-exchanger the, for example, a brazing sheet wherein JIS 3003 (Al-0.15 wt. % Cu-1.1 wt. % Mn) alloy is used as a core material and, on one side of said core material, JIS 7072 (Al-1 wt. % Zn) alloy is cladded as an internal lining material and, on the other side, JIS 4045 (Al-10 wt. % Si) alloy or the like is cladded usually as a soldering material is as the side of said internal lining material which becomes inside, meaning, the side which contacts the refrigerant at all times. Moreover, for the fin material, corrugated JIS 3003 alloy or an improved material allowed to contain Zn etc. for the purpose of giving the sacrificial effect thereto is used.

And, these are assembled unitedly by soldering.

Next, in the prior art multilayer type evaporator, as shown in FIG. 2, fins (5) and pathway-constituting sheets (6) and (6') forming path way (7) of refrigerant and comprising brazing sheet are layered alternately and these are joined by soldering. For this fin (5), around 0.1 mm thick brazing sheet is used ordinarily and, for the pathway-constituting sheet (6) or (6'), about 0.5 mm thick brazing sheet is used.

For such evaporator, for preventing the pathway of refrigerant from the external corrosion, a fin material comprising JIS 3003 alloy or an alloy allowed to contain Zn etc. for the purpose of giving the sacrificial effect thereto is used and, for the material of refrigerant's pathway, an alloy added with Cu, Zr, etc. to Al-1 wt. % Mn alloy, if necessary, is used as a core material and, on the surface, soldering material such as JIS 4004 (Al-9.7 wt. % Si-1.5 wt. % Mg) alloy or JIS 4343 Al-7.5 wt. % Si) alloy is cladded and used.

The prior art serpentine type condenser is shown in FIG. 3. In this, a tube (8) molded by extruding tubularly in a hot or warm state is folded meanderingly and, in the openings of this tube (8), corrugated fins (9) comprising brazing sheet are attached. Additionally numeral (10) in the diagram indicates a connector.

As the materials of such condenser, for said tube, JIS 3003 alloy or the like is used and, for the corrugated fin, such one that JIS 3003 alloy or an alloy allowed to contain Zn etc. for the purpose of giving the sacrificial effect thereto is used as a core material and, on both sides, soldering material such as JIS 4004 alloy or JIS 4343 alloy is cladded is used.

All of above-mentioned heat-exchangers etc. are assembled by brazing to unify by heating to a temperature near 600° C. and joining with soldering material. This brazing method includes vacuum brazing method, flux brazing method, a brazing method using a potassium fluo-aluminate brazing flux (NOCOLOCK) which is non-corrosive, and the like.

The trend in heat-exchangers is toward lighter weight and miniaturization and, for this reason, thinning of wall of materials is desired. However, if thinning of the wall is made with conventional materials, then first there has been a problem that, as the thickness of materials decreases, the thermal conductivity ends up to decrease resulting in decreased thermal efficiency of heat-exchanger. For this problem, Al-Zr alloy material etc. have been developed as conventional fin materials, which, in turn, have a new problem of low strength.

Moreover, as a second problem, there is lack of strength by thinning the wall. For this problem, some high-strength alloys have been proposed, but any alloy with sufficient strength is still not obtained. This is because the ingredients of high-strength alloys themselves are restricted in view of the solderability, corrosion resistance, etc. aforementioned and, in addition, due to the brazing to be heated near 600° C. in the final process of production, strength-improving mechanisms such as hardening cannot be utilized.

As a result of extensive investigations in view or this situation, a production method of aluminum alloy heat-exchanger with excellent thermal efficiency, high-strength and excellent corrosion resistance has been developed by the invention.

SUMMARY OF THE INVENTION

The production method of the invention is characterized by producing an aluminum alloy heat-exchanger by soldering technique. The heat exchanger, after soldering, is retained for a predetermined period of time, ranging from 10 minutes to 30 hours, at a temperature ranging from 400° to 500 ° C. It is preferable to retain the heat-exchanger during cooling after soldering. Alternatively, the heat exchanger may be cooled to 150° C. or lower and reheated to 400° to 500° C. for at least 10 minutes to up to 30 hours. Furthermore, it is preferable to cool the heat-exchanger at a cooling velocity of at least 30° C./min across a temperature range of 200° to 400° C. after the retainment.

Moreover, as the soldering technique, said flux soldering method, a soldering method using a postassium fluo-aluminate brazing flux (NOCOLOCK) or vacuum brazing method can be used and, in the case of vacuum brazing method, Al-Si-Mg-based Al alloy is preferable as a soldering material.

Furthermore, as the fin material of the aluminum alloy heat-exchanger, it is preferable to use a bare material of Al alloy containing Si: 0.05–1.0 wt. %, Fe: 0.1–1.0 wt. % and Mn: 0.05–1.5 wt. % and further containing one kind or not less than two kinds of Cu: not more than 0.5 wt. %, Mg: not more than 0.5 wt. %, Cr: not more than 0.3 wt. %, Zr not more than 0.3 wt. %, Ti: not more than 0.3 wt. %, Zn: not more than 2.5 wt. %, In: not more than 0.3 wt. % and Sn: not more than 0.3 wt. % (however, in the case of vacuum brazing method, Zn is deleted), the balance comprising Al and inevitable impurities, or a bare material of Al alloy containing Si: 0.05–1.0 wt. %, Fe: 0.1–1.0 wt. % and Zr:

0.03–0.3 wt. % and further containing one kind or not less than two kinds of Cu: not more than 0.5 wt. %, Mg: not more than 0.5 wt. %, Cr: not more than 0.3 wt. %, Ti: not more than 0.3 wt. %, Zn: not more than 2.5 wt. %, In: not more than 0.3 wt. % and Sn: not more than 0.3 wt. % (however, in the case of vacuum brazing method, Zn is deleted), the balance comprising Al and inevitable impurities, or a brazing sheet using said Al alloy as a core material.

Still more, as the pathway-constituting member for refrigerant of aluminum alloy heat-exchanger, it is better to use a bare material of Al alloy containing Si: 0.05–1.0 wt. % and Fe: 0.1–1.0 wt. % and further containing one kind or not less than two kinds of Mn: not more than 1.5 wt. %, Cu: not more than 1.0 wt. %, Mg: not more than 0.5 wt. %, Cr: not more than 0.3 wt. %, Zr: not more than 0.3 wt. % and Ti: not more than 0.3 wt. %, the balance comprising Al and inevitable impurities, or a brazing sheet using said Al alloy as a core material.

And, in the invention, it is only necessary to use the bare material for either one of fin and pathway of refrigerant and the brazing sheet for the other. The above, and other objects, features and advantages of the present invention will become apparent from the following description read in conjunction with the accompanying drawings, in which like reference numerals designate the same elements.

DETAILED DESCRIPTION OF THE INVENTION

Figure 1:
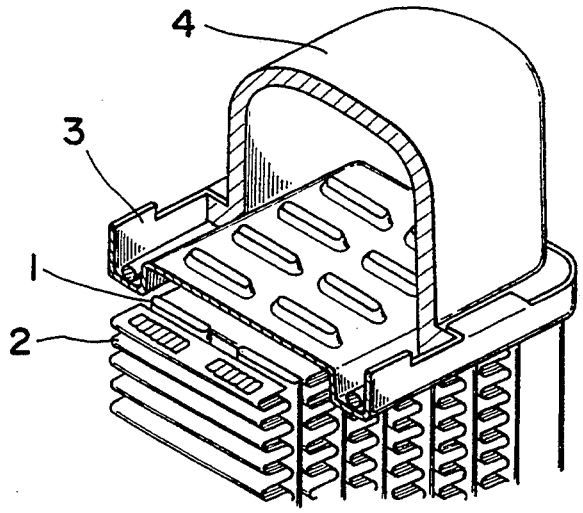
PRIOR ART Fig. 1
FIG. 1 is an oblique view shown by notching a part of a prior art radiator.

In following, the invention will be illustrated in detail.

First, the soldering technique used in the invention may be any of conventional vacuum brazing method, flux brazing method, a brazing method using a potassium fluo-aluminate brazing flux (NOCOLOCK), etc. using soldering materials described in JIS 4004, JIS 4343, JIS 4045, etc. and is not particularly restricted. This is because the invention provides a method of improving the characteristics of a heat-exchanger by treating the heat-exchanger once it is heated for soldering, hence it is unrelated to the previous soldering itself. The assembling prior to soldering, washing and flux coating in the case of flux soldering method, etc. may by performed as usual. Further, at this time, the soldering conditions determined based on the solderability, collapse prevention of fin, etc. are not needed to be altered particularly. Consequently, the characteristics accompanying on soldering such as solderability are not aggravated by the invention.

And, in the invention, the heat-exchanger is retained for 10 minutes to 30 hours at 400° to 500° C. after the heating for soldering. It is also possible to cool the heat-exchanger after soldering to 150° C. or lower during a period until this retainment.

The reason why the heat-exchanger is once cooled to 150° C. or lower in this way is because the cooling is effective for generating intermetallic compounds to become the nuclei for deposition during raising the temperature to retaining temperature thereafter. If raising the temperature from the temperature over 150° C., the intermetallic compounds would hardly generate. Besides, the heat-exchanger may be safely cooled, of course, to room temperature, for example, if being under 150° C.

And, in the invention, the heat-exchanger after soldering is retained for 10 minutes to 30 hours at 400° to 500° C. with cooling to 150° C. or lower or without cooling in this way. This is one of the essential elements of the invention and has been obtained as a result of diligent investigations by the inventors on the change in the metal texture of materials during the heating for soldering. Namely, the heating for soldering is usually performed at a temperature near 600° C. and, at this time, the alloy elements in material come to solid solution in considerable amounts. For example, in the case of JIS 3003 alloy, the formation of solid solution progresses during temperature-raising on heating for soldering and retainment until about 1.0 wt. % of Mn, about 0.025 wt. % of Fe and all amounts of Si come to solid solution.

With conventional heat-exchanger, materials, the alloy elements having come to solid solution in this way, have been used, but, in the invention, such elements having come to solid solution during soldering are deposited, thereby improving the thermal conductivity of the material and improving the thermal efficiency of the heat-exchanger. Namely, when retaining within said temperature range, mainly Mn, Fe and Si contained as added elements and inevitable impurities in the material deposit, hence the thermal conductivity of material improves and, as a result, the heat-exchange efficiency improves by about 3% over the case not performing this treatment, though results differ depending on the material alloys used.

Since such treatment is carried out for the overall part of heat-exchanger in the invention, the thermal conductivity of pathway of refrigerant, the thermal conductivity thereof having been not taken into account hitherto, improves, not to speak of that of the fin, leading to extremely improved thermal efficiency as a heat-exchanger.

Here, the reason why said retaining temperature was restricted to 400° to 500° C. is because when the temperature is over 500° C. or under 400° C., the progress of deposition of Mn, Fe, Si, etc. contributing significantly to the improvement in the thermal conductivity is slow and, in addition, in the case of the retaining time being under 10 minutes, sufficient amount of deposition cannot be achieved. Hence, the conditions were determined to retain at 400° to 500° C. for 10 minutes or longer.

Moreover, even if making the retaining time over 30 hours, subsequent deposition is low, leading to poor economy. Hence, the retainment was made to be 30 hours or shorter.

At this time, if retaining particularly under 400° C., the deposited phase formed in the pathway of refrigerant during temperature-raising does not come again to the solid solution by heating, resulting in decreased corrosion resistance.

When performing the above-mentioned treatment of the invention, the amount of solid solution decreases to 0.1 wt. % for Mn and about 0.001 wt. % for Fe, and, at that time, compounds containing Si also deposit, resulting in decreased amount of Si solid solution.

Besides, it is not necessary to retain the invention at a constant temperature, it does not matter whatever the temperature may vary, if being within a temperature range of 400° to 500° C.

Further, since the invention attempts to improve the characteristics by altering the metal texture of such materials, the inventive treatment during cooling after finishing soldering may be performed either in vacuum or in atmosphere.

Moreover, in the invention, the cooling within, a temperature range from over 200° C. to under 400° C. is performed at a cooling velocity of not slower than 30° C./min after the retainment of said temperature. This is for the reason of preventing the deposition of simple substance Si, Mg-based compounds and Cu-based compounds. These compounds are liable to deposit at a temperature near 300° C., but all are harmful for the corrosion resistance of pathway of refrigerant. Hence, by suppressing the deposition, the corrosion resistance improves and further, through the solid solution effect and the cold aging effect of these elements, the strength improves.

Here, in the case of the cooling velocity being under 30° C./min, said deposition is caused during cooling to decrease the corrosion resistance and further to lose the effect on the improvement in strength. Moreover, the reason why the temperature range for performing the cooling at not slower than 30° C./min was determined to be over 200° C. and under 400° C. is, since the deposition velocity is slow at a temperature under 200° C., the deposition is not caused so much even by gradual cooling at a cooling velocity of under 30° C./min and, since the deposition is low at a temperature over 400° C., the gradual cooling at under 30° C./min is not needed. Besides, conventional average cooling velocity was 10° C./min or so, which was a cause for decreased characteristics.

Said method of cooling may be any of in-furnace air cooling, blast air cooling, water cooling, mist spraying, etc. and is not particularly regulated.

The production method of the invention has been illustrated above. In following, illustration will be made about the aluminum alloys to be used as the materials of the heat-exchanger of the invention.

In the aluminum alloys used usually in the industry, Fe and Si are surely contained as the inevitable impurities. In the invention, however, even aluminum alloys containing such elements are applicable, since Fe and Si are deposited as mentioned above.

Hence, the alloys are not restricted, but, when using an alloy containing about 1 wt. % of Mn being conventional JIS 3003 alloy, the improving effect on thermal efficiency through the deposition of Mn appears conspicuously, and, also with materials aiming at the improved strength by the addition of Mg, Cu and Si, the improvement in strength can be aimed further because of the regulation of cooling velocity. Moreover, Al-Zr alloys exert more improving effect in thermal efficiency due to the deposition of Zr.

Moreover, as mentioned above, the soldering material does not affect the invention, thus Al-Si-based or Al-Si-Mg-based soldering materials used hitherto may be used, and no restriction is made in the invention.

Besides, such processes as the removal of flux and the painting onto a heat-exchanger may be carried out as usual after the treatment of the invention.

In following, the invention will be illustrated concretely based on the examples.

EXAMPLE 1

Fins A and B with a thickness of 0.08 mm (both are bare materials) comprising the compositions shown in Table 1 were produced by a conventional method.

Also, 0.4 mm thick coil-shaped plate materials were produced by usual method, wherein alloys having the compositions shown in Table 2 were used as core materials and soldering materials shown in Table 2 were cladded on one side thereof in a thickness of 10% per side, and thereafter these plate materials were converted to 35.0 mm wide strip materials with slitter, adjusting to the size of seam welded pipe. Further, these strip materials were processed to 16.0 mm wide, 2.2 mm thick seam welded pipes for fluid-passing pipe using a device for producing seam welded pipe to produce flat tubes a and b.

Moreover, 1 mm thick coil-shaped plate materials wherein alloys having the same compositions as the core material alloys shown in Table 2 were used as core materials and JIS 7072 alloy was cladded on one side of each of those core materials in a thickness of 10% per side were slitted to produce 60 mm wide header plates a and b. Namely, the header plate consisting of the core material having the same composition as the core material of flat tube a in table 2 was made plate a and the header plate consisting of the core material having the same composition as the core material of flat tube b was made plate b.

TABLE 1

| Fin symbol | Composition of alloy (wt. %) | | | | | | | |
|---|---|---|---|---|---|---|---|---|
| | Si | Fe | Cu | Mn | Zn | Zr | Ti | Al |
| A | 0.23 | 0.45 | 0.06 | 1.11 | 1.12 | — | 0.01 | Balance |
| B | 0.18 | 0.62 | — | — | 1.10 | 0.14 | " | " |

TABLE 2

| Flat tube symbol | Composition of core material alloy (wt. %) | | | | | | | | | Soldering material |
|---|---|---|---|---|---|---|---|---|---|---|
| | Si | Fe | Cu | Mn | Mg | Cr | Zr | Ti | Al | JIS |
| a | 0.29 | 0.50 | 0.14 | 1.15 | — | — | — | 0.01 | Balance | 4343 |
| b | 0.56 | 0.52 | 0.45 | 1.20 | 0.34 | 0.15 | 0.15 | " | " | 4045 |

*In the table, core material alloy of symbol a represents JIS 3003 alloy.

All members of fin, flat tube and plate above were combined as in Table 4 to assemble a radiator shown in FIG. 1 and, after coated with 10% concentration liquor of fluoride type flux thereonto, the assembly was heated in nitrogen gas under usual conditions to solder.

And, after allowed to cool to each temperature shown in table 3, this was heated to each temperature shown in table 3 and retained at that temperature. Then, it was treated under the conditions of reheating and cooling to cool to the room temperature at each cooling velocity shown in table 3 to obtain a radiator.

Of the radiator thus obtained, the thermal efficiency and the corrosion resistance were examined, and are shown in Table 4.

Thermal efficiency was determined according to JIS D1618 (Test method of automobile air conditioner) and the proportion of improvement to the thermal efficiency of the radiator obtained by conventional method was indicated by percentage.

Moreover, for the corrosion resistance, CASS test was performed for 720 hours to determine the depth of pit corrosion generated in the tube, which was indicated by the maximum depth of pit corrosion. Besides, the corrosion resistance can be said to be good, when the maximum depth of pit corrosion is less than 0.1 mm.

Moreover, the same materials as the fin and flat tube of the radiator submitted at the time of heating for soldering of the radiator and at the times of reheating and cooling under each condition shown in Table 3 were heated for soldering and reheated and cooled simultaneously to determine the strength, as shown in Table 4 as the strength of fin material and the strength of tube material, respectively.

TABLE 3

| Production method | No. | Cooling temperature after soldering (°C.) | Heating conditions Temperature (°C.) | Heating conditions Time | Cooling Velocity (°C./min) |
|---|---|---|---|---|---|
| Inventive method | 1 | 20 | 480 | 2 hr | 50 |
| | 2 | 100 | 450 | 20 min | 100 |
| | 3 | 20 | 420 | 12 hr | 50 |
| | 4 | 20 | 450 | 2 hr | 1000° C./Sec or faster (Water cooling) |
| Comparative method | 5 | 250 | 480 | 2 hr | 50 |
| | 6 | 20 | 300 | 2 hr | 50 |
| | 7 | 20 | 520 | 2 hr | 100 |
| | 8 | 20 | 480 | 2 hr | 1 |
| Conventional method | 9 | No treatments of reheating and cooling | | | |

TABLE 4

| Radiator No. | Symbol of member Fin | Tube | Plate | Production method | Improvement rate of thermal efficiency % | Max. depth of pit corrosion mm | Strength of fin material kgf/mm$^2$ | Strength of tube material kgf/mm$^2$ |
|---|---|---|---|---|---|---|---|---|
| 1 | A | a | a | Inventive method No. 1 | 2.0 | ≦0.05 | 12.5 | 12.5 |
| 2 | " | " | " | Inventive method No. 2 | 2.0 | ≦0.05 | 12.5 | 12.5 |
| 3 | " | " | " | Inventive method No. 3 | 3.0 | ≦0.05 | 12.5 | 12.5 |
| 4 | " | " | " | Inventive method No. 4 | 2.5 | ≦0.05 | 12.5 | 12.5 |
| 5 | " | " | " | Comparative method No. 5 | 1.0 | 0.10 | 12.5 | 12.5 |
| 6 | " | " | " | Comparative method No. 6 | 0.5 | 0.2 | 12.0 | 12.0 |
| 7 | " | " | " | Comparative method No. 7 | 0.5 | 0.10 | 12.5 | 12.5 |
| 8 | " | " | " | Comparative method No. 8 | 2.5 | * | 12.0 | 12.0 |
| 9 | " | " | " | Conventional method No. 9 | — | ≦0.05 | 12.0 | 12.0 |
| 10 | B | b | b | Inventive method No. 1 | 2.5 | ≦0.05 | 8.0 | 18.0 |
| 11 | " | " | " | Inventive method No. 2 | 2.5 | ≦0.05 | 8.0 | 18.0 |
| 12 | " | " | " | Inventive method No. 3 | 3.0 | ≦0.05 | 8.0 | 18.0 |
| 13 | " | " | " | Inventive method No. 4 | 2.5 | ≦0.05 | 8.0 | 18.0 |
| 14 | " | " | " | Comparative method No. 5 | 1.0 | 0.10 | 8.0 | 18.0 |
| 15 | " | " | " | Comparative method No. 6 | 0.5 | * | 7.5 | 17.0 |
| 16 | " | " | " | Comparative method No. 7 | 0.5 | 0.10 | 8.0 | 18.0 |
| 17 | " | " | " | Comparative method No. 8 | 2.5 | * | 7.5 | 17.0 |
| 18 | " | " | " | Conventional Method No. 9 | — | * | 7.5 | 17.0 |

Piercing pit corrosion is generated in the case of mark *.

From Table 4, it is evident that the radiators according to the inventive production method show high improvement effect on the thermal efficiency and also excellent corrosion resistance. Further, the strength of members is equal to or more excellent than that of members by conventional method, even if the inventive treatments of reheating and cooling may be performed. It can be seen therefore that the inventive production method does not give an adverse effect on the strength of members at all.

EXAMPLE 2

Figure 2:
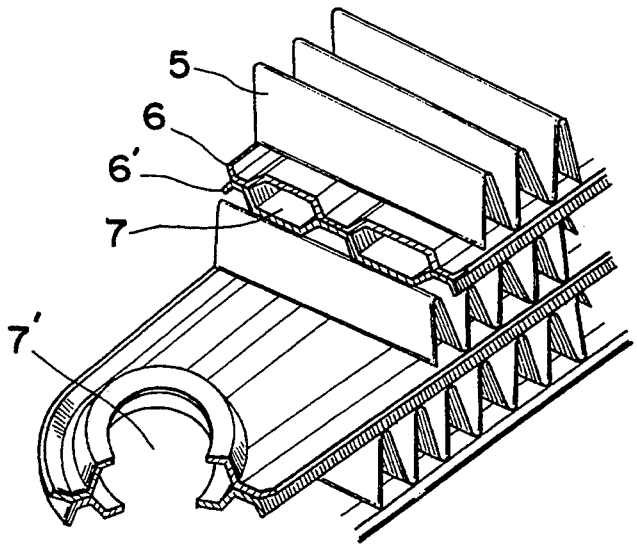
PRIOR ART Fig. 2
FIG. 2 is an oblique view shown by notching a part of a prior art multilayer type evaporator.

By combining fin A or B shown in Table 1 with a pathway-constituting sheet comprising 0.6 mm thick brazing sheet cladded with JIS 4004 alloy on both sides of plate material of Al-0.31 wt. % Si-0.22 wt. % Fe-0.45 wt. % Cu-1.21 wt. % Mn-0.01 wt. % Ti alloy each in a thickness of 10 %, a core of a multilayer type evaporator shown in FIG. 2 was assembled and the vacuum brazing was carried out under conventional conditions to unify.

Thereafter, as shown in table 5, cores No. 1 through No. 18 were treated, respectively, under the reheating and cooling conditions shown in Table 3 for the Inventive methods No. 1 through No. 4, Comparative methods No. 5 through No. 8 or Conventional method No. 9 to obtain multilayer type evaporators.

Of the evaporators thus obtained, the thermal efficiency and the corrosion resistance were examined similarly to above (Example 1), the results of which are shown in table 5.

Moreover, the same materials as the fin and plate of core submitted at the time of heating for soldering of said core and at the time of reheating and cooling under each condition shown in Table 3 were heated for soldering and reheated and cooled simultaneously to determine the strength, which shown in Table 5 as the strength of fin material and the strength of plate material, respectively.

TABLE 5

| Core No. | Symbol of fin | Production method (See Table 3) | Improvement rate of thermal efficiency % | Max. depth of pit corrosion mm | Strength of fin material kgf/mm$^2$ | Strength of plate material kgf/mm$^2$ |
|---|---|---|---|---|---|---|
| 1 | A | Inventive method No. 1 | 2.0 | ≦0.05 | 12.5 | 13.5 |
| 2 | " | Inventive method No. 2 | 2.0 | ≦0.05 | 12.5 | 13.5 |
| 3 | " | Inventive method No. 3 | 3.0 | ≦0.05 | 12.5 | 13.5 |
| 4 | " | Inventive method No. 4 | 2.5 | ≦0.05 | 12.5 | 13.5 |
| 5 | " | Comparative method No. 5 | 1.0 | 0.10 | 12.5 | 13.5 |
| 6 | " | Comparative method No. 6 | 0.5 | * | 12.0 | 13.0 |
| 7 | " | Comparative method No. 7 | 0.5 | 0.10 | 12.5 | 13.5 |
| 8 | " | Comparative method No. 8 | 2.5 | * | 12.0 | 13.0 |
| 9 | " | Conventional method No. 9 | — | ≦0.05 | 12.0 | 13.0 |
| 10 | B | Inventive method No. 1 | 2.0 | ≦0.05 | 8.0 | 13.5 |
| 11 | " | Inventive method No. 2 | 2.5 | ≦0.05 | 8.0 | 13.5 |
| 12 | " | Inventive method No. 3 | 2.5 | ≦0.05 | 8.0 | 13.5 |
| 13 | " | Inventive method No. 4 | 2.0 | ≦0.05 | 8.0 | 13.5 |
| 14 | " | Comparative method No. 5 | 1.0 | 0.10 | 8.0 | 13.5 |
| 15 | " | Comparative method No. 6 | 0.5 | * | 7.5 | 13.0 |
| 16 | " | Comparative method No. 7 | 0.5 | 0.10 | 8.0 | 13.5 |
| 17 | " | Comparative method No. 8 | 2.5 | * | 7.5 | 13.0 |
| 18 | " | Conventional method No. 9 | — | ≦0.05 | 7.5 | 13.0 |

Piercing pit corrosion is generated in the case of mark *.

According to Table 5, it is evident that the multilayer type evaporators by the inventive method are excellent in the thermal efficiency and the corrosion resistance and further have the strength of members also equal or higher compared with that of members by conventional production.

EXAMPLE 3

Fins C (thickness 0.14 mm) and D (thickness 0.16 mm) comprising brazing sheets wherein Aluminum alloys having the compositions shown in Table 6 were used as the core materials and JIS 4045 alloy or JIS 4343 alloy soldering material was cladded on both sides thereof in a thickness of 10% as shown in table 6 were produced. And, a 0.05 mm thick extruded multihole tube comprising Al-0.21 wt. % Si-0.54 wt. % Fe-0.15 wt. % Cu-1.11 wt. % Mn-0.01 wt. % Ti alloy (JIS 3003 alloy) was bent meanderingly, said fins C and D were attached in the openings of this tube, chloride type flux was coated, cores of condenser shown in FIG. 3 were assembled, and the soldering was carried out under conventional conditions.

Thereafter, as shown in Table 7, cores No. 19 through No. 36 were treated, respectively, under the reheating and cooling conditions shown in Table 3 to obtain serpentine type condensers.

TABLE 6

| Fin No. | Composition of core material alloy (wt. %) | | | | | | | Solder |
|---|---|---|---|---|---|---|---|---|
| | Si | Fe | Mn | Zn | Zr | Ti | Al | JIS |
| C | 0.34 | 0.55 | 1.20 | 1.10 | 0.10 | 0.01 | Balance | 4045 |

TABLE 6-continued

| Fin No. | Composition of core material alloy (wt. %) | | | | | | | Solder JIS |
|---|---|---|---|---|---|---|---|---|
| | Si | Fe | Mn | Zn | Zr | Ti | Al | |
| D | 0.46 | 0.45 | — | 1.12 | 0.15 | 0.01 | " | 4343 |

Of the condensers thus obtained, the thermal efficiency and the corrosion resistance were examined similarly to above (Example 1), the results of which are shown in Table 7.

Moreover, the same materials as the fin and extruded tube of core submitted at the time of heating for soldering of said core and at the times of reheating and cooling under each condition shown in Table 3 were heated for soldering and reheated and cooled simultaneously to determine the strength, which shown in Table 7 as the strength of fin material and the strength of tube material, respectively.

TABLE 7

| Core No. | Symbol of fin | Production method (See Table 3) | Improvement rate of thermal efficiency % | Max. depth of pit corrosion mm | Strength of fin material kgf/mm$^2$ | Strength of plate material kgf/mm$^2$ |
|---|---|---|---|---|---|---|
| 19 | C | Inventive method No. 1 | 2.0 | ≦0.05 | 13.0 | 12.5 |
| 20 | " | Inventive method No. 2 | 2.0 | ≦0.05 | 13.0 | 12.5 |
| 21 | " | Inventive method No. 3 | 2.5 | ≦0.05 | 13.0 | 12.5 |
| 22 | " | Inventive method No. 4 | 2.5 | ≦0.05 | 13.0 | 12.5 |
| 23 | " | Comparative method No. 5 | 1.0 | 0.10 | 13.0 | 12.5 |
| 24 | " | Comparative method No. 6 | 0.5 | 0.2 | 12.5 | 12.0 |
| 25 | " | Comparative method No. 7 | 0.5 | 0.10 | 13.0 | 12.5 |
| 26 | " | Comparative method No. 8 | 2.5 | 0.2 | 12.5 | 12.0 |
| 27 | " | Conventional method No. 9 | — | ≦0.05 | 12.5 | 12.0 |
| 28 | D | Inventive method No. 1 | 2.0 | ≦0.05 | 8.0 | 12.5 |
| 29 | " | Inventive method No. 2 | 2.0 | ≦0.05 | 8.0 | 12.5 |
| 30 | " | Inventive method No. 3 | 2.5 | ≦0.05 | 8.0 | 12.5 |
| 31 | " | Inventive method No. 4 | 2.0 | ≦0.05 | 8.0 | 12.5 |
| 32 | " | Comparative method No. 5 | 0.8 | 0.10 | 8.0 | 12.5 |
| 33 | " | Comparative method No. 6 | 0.5 | * | 7.5 | 12.0 |
| 34 | " | Comparative method No. 7 | 0.5 | 0.10 | 8.0 | 12.5 |
| 35 | " | Comparative method No. 8 | 0.5 | 0.10 | 8.0 | 12.5 |
| 36 | " | Conventional method No. 9 | — | ≦0.05 | 7.5 | 12.0 |

Piercing pit corrosion is generated in the case of mark *.

According to Table 7, it can be seen that the condensers produced by the inentive method are excellent in both the thermal efficiency and the corrosion resistance. Further, the strength of members was equal or higher over the members by conventional method.

EXAMPLE 4

Fin materials E and F with a thickness of 0.08 mm and extruded tube material G with a thickness of 0.5 mm having the compositions shown in Table 8 were produced by a conventional method (all are bare materials).

Moreover, fin materials H and I and seam welded tube materials J and K comprising brazing sheets wherein alloys having the compositions shown in Table 9 were used as core materials and the soldering material was cladded on both sides or one side thereof under the conditions shown Table 10 were produced in thicknesses shown in Table 10.

TABLE 8

| Symbol of material | Composition of alloy (wt. %) | | | | | | | |
|---|---|---|---|---|---|---|---|---|
| | Si | Fe | Cu | Mn | Zn | Zr | Ti | Al |
| Fin material E | 0.23 | 0.45 | 0.06 | 1.11 | 1.12 | — | 0.01 | Balance |
| Fin material F | 0.18 | 0.62 | — | — | 1.10 | 0.14 | " | " |
| Tube material G | 0.21 | 0.54 | 0.15 | 1.11 | — | — | " | " |

*In the table, composition of tube G corresponds to JIS 3003.

TABLE 9

| Symbol of core material alloy | Composition of core material alloy (wt. %) | | | | | | | | | |
|---|---|---|---|---|---|---|---|---|---|---|
| | Si | Fe | Cu | Mn | Mg | Zn | Cr | Zr | Ti | Al |
| d | 0.34 | 0.55 | — | 1.20 | — | 1.10 | — | 0.10 | 0.01 | Balance |
| e | 0.46 | 0.45 | — | — | — | 1.12 | — | 0.15 | " | " |
| f | 0.29 | 0.50 | 0.14 | 1.15 | — | — | — | — | " | " |
| g | 0.56 | 0.52 | 0.45 | 1.20 | 0.34 | — | 0.15 | 0.15 | " | " |

*In the table, composition of core material f coresponds to JIS 3003.

TABLE 10

| Symbol of material | Symbol of core material alloy | Cladding rate | Soldering Material (JIS) | Thickness (mm) |
|---|---|---|---|---|
| Fin material H | d | 10% on both sides | 4045 | 0.14 |
| Fin material I | e | 10% on both sides | 4343 | 0.16 |
| Tube material J | f | 10% on one side | 4343 | 0.4 |
| Tube material K | g | 10% on one side | 4045 | 0.4 |

Each of said fin materials and tube materials was treated in nitrogen gas under the heating conditions for soldering, raising the temperature at 50° C./min and successively retaining for 5 minutes at 600° C., and thereafter treatment under the conditions shown in Table 11 was given in the cooling process.

And, with each plate material obtained, corrosion resistance test, tensile test and measurement of electrical conductivity were performed, the results of which are shown in Table 12 through Table 15. For fin materials, only the tensile test and the measurement of electrical conductivity were performed.

For the corrosion resistance test, after the completion of said treatment, the corrosion test was carried out under the following conditions exposing only the central area of the surface of each tube material and sealing the rest of the surface.

Namely, cycle test wherein each tube material after seal treatment was dipped into an ASTM artificial water (aqueous solution containing 100 ppm of $Cl^-$, 100 ppm of $CO_3^{2-}$ and 100 ppm of $SO_4^{2-}$) and then it was allowed to stand for 16 hours at room temperature was performed 90 times. And, after the finish of this cycle test, the corrosion products on each tube material were removed with a mixed solution of phosphoric acid and chromic acid. Then, the maximum depth of pit corrosion was determined by the focus depth method using optical microscope. Furthermore, the cross section of corroded area was polished and the generating status of crystal boundary corrosion was examined to evaluate the corrosion resistance.

Next, for the tensile test, after treatment of each plate material, the plate material was allowed to stand for 4 days at room temperature, the measurement was made.

Moreover, the electrical conductivity was measured at 20° C. by double bridge method. Besides, the electrical conductivity is an index of the thermal conductivity and, if the electrical conductivity of fin improves by 10% IACS, then the thermal efficiency of heat-exchanger improves by

TABLE 11

| Production method | No. | Cooling velocity to retaining temperature (°C./min) | Retaining conditions Temperature (°C.) | Retaining conditions Time | Cooling velocity to room temperature (°C./min) |
|---|---|---|---|---|---|
| Inventive method | 10 | 10 | 480 | 2 hr | 50 |
| | 11 | 10 | 410 | 30 min | 100 |
| | 12 | 10 | 450 | 18 hr | 100 |
| | 13 | 10 | 450 | 2 hr | 1000° C./sec or faster (water cooling) |
| Comparative method | 14 | 10 | 300 | 30 min | 100 |
| | 15 | 10 | 450 | 30 min | 5 |
| | 16 | (No retainment) Cooled to room temperature at 100° C./min. | | | |
| Conventional method | 17 | (No retainment) Cooled to room temperature at 20° C./min. | | | |

TABLE 12

| Symbol of material | Production method (See Table 11) | Tensile strength kgf/mm² | Electrical conductivity % IACS |
|---|---|---|---|
| Fin material E | Inventive method No. 10 | 12.5 | 45.0 |
| | Inventive method No. 11 | 12.5 | 46.0 |
| | Inventive method No. 12 | 12.5 | 47.0 |
| | Inventive method No. 13 | 12.5 | 46.0 |
| | Comparative method No. 14 | 12.0 | 38.0 |
| | Comparative method No. 15 | 12.0 | 46.0 |
| | Comparative method No. 16 | 12.0 | 35.0 |
| | Conventional method No. 17 | 12.0 | 36.0 |
| Fin material F | Inventive method No. 10 | 8.0 | 58.0 |
| | Inventive method No. 11 | 8.0 | 59.0 |
| | Inventive method No. 12 | 8.0 | 59.5 |
| | Inventive method No. 13 | 8.0 | 58.0 |
| | Comparative method No. 14 | 7.5 | 53.0 |
| | Comparative method No. 15 | 7.5 | 58.0 |
| | Comparative | 8.0 | 50.5 |

TABLE 12-continued

| Symbol of material | Production method (See Table 11) | Tensile strength kgf/mm$^2$ | Electrical conductivity % IACS |
|---|---|---|---|
| | method No. 16 | | |
| | Conventional method No. 17 | 7.5 | 51.0 |

TABLE 13

| Symbol of material | Production method (See Table 11) | Tensile strength kgf/mm$^2$ | Electrical conductivity % IACS |
|---|---|---|---|
| Fin material H | Inventive method No. 10 | 13.0 | 45.0 |
| | Inventive method No. 11 | 13.0 | 45.5 |
| | Inventive method No. 12 | 13.0 | 46.0 |
| | Inventive method No. 13 | 13.0 | 45.0 |
| | Comparative method No. 14 | 12.5 | 37.5 |
| | Comparative method No. 15 | 12.5 | 45.5 |

TABLE 13-continued

| Symbol of material | Production method (See Table 11) | Tensile strength kgf/mm$^2$ | Electrical conductivity % IACS |
|---|---|---|---|
| | Comparative method No. 16 | 13.0 | 33.5 |
| | Conventional method No. 17 | 12.5 | 34.0 |
| Fin material I | Inventive method No. 10 | 8.0 | 58.5 |
| | Inventive method No. 11 | 8.0 | 59.0 |
| | Inventive method No. 12 | 8.0 | 59.0 |
| | Inventive method No. 13 | 8.0 | 58.5 |
| | Comparative method No. 14 | 7.5 | 53.0 |
| | Comparative method No. 15 | 7.5 | 58.0 |
| | Comparative method No. 16 | 8.0 | 50.0 |
| | Conventional method No. 17 | 7.5 | 50.0 |

TABLE 14

| Symbol of material | Production method (See Table 11) | Max. depth of pit corrosion mm | Generation of crystal boundary corrosion | Tensile strength kgf/mm$^2$ | Electrical conductivity % IACS |
|---|---|---|---|---|---|
| Tube material G | Inventive method No. 10 | ≦0.05 | No | 12.5 | 46.0 |
| | Inventive method No. 11 | ≦0.05 | " | 12.5 | 47.0 |
| | Inventive method No. 12 | ≦0.05 | " | 12.5 | 48.0 |
| | Inventive method No. 13 | ≦0.05 | " | 12.5 | 47.0 |
| | Comparative method No. 14 | 0.2 | Yes | 12.0 | 39.0 |
| | Comparative method No. 15 | 0.2 | " | 12.0 | 47.0 |
| | Comparative method No. 16 | ≦0.05 | No | 12.5 | 36.0 |
| | Conventional method No. 17 | ≦0.05 | " | 12.0 | 37.0 |
| Tube material J | Inventive method No. 10 | ≦0.05 | No | 12.5 | 45.5 |
| | Inventive method No. 11 | ≦0.05 | " | 12.5 | 47.0 |
| | Inventive method No. 12 | ≦0.05 | " | 12.5 | 47.0 |
| | Inventive method No. 13 | ≦0.05 | " | 12.5 | 46.5 |
| | Comparative method No. 14 | 0.2 | Yes | 12.0 | 38.0 |
| | Comparative method No. 15 | 0.2 | " | 12.0 | 46.5 |
| | Comparative method No. 16 | ≦0.05 | No | 12.5 | 36.0 |
| | Conventional method No. 17 | ≦0.05 | " | 12.0 | 36.5 |

TABLE 15

| Symbol of material | Production method (See Table 11) | Max. depth of pit corrosion mm | Generation of crystal boundary corrosion | Tensile strength kgt/mm$^2$ | Electrical conductivity % IACS |
|---|---|---|---|---|---|
| Tube material K | Inventive method No. 10 | ≦0.05 | No | 18.0 | 42.5 |
| | Inventive method No. 11 | ≦0.05 | " | 18.0 | 43.0 |
| | Inventive method No. 12 | ≦0.05 | " | 18.0 | 44.0 |
| | Inventive | ≦0.05 | " | 18.0 | 43.0 |

TABLE 15-continued

| Symbol of material | Production method (See Table 11) | Max. depth of pit corrosion mm | Generation of crystal boundary corrosion | Tensile strength kgt/mm$^2$ | Electrical conductivity % IACS |
|---|---|---|---|---|---|
| | method No. 13 | | | | |
| | Comparative method No. 14 | Piercing pit corrosion | Yes | 17.0 | 34.5 |
| | Comparative method No. 15 | Piercing pit corrosion | " | 17.0 | 43.0 |
| | Comparative method No. 16 | ≦0.05 | No | 18.0 | 29.5 |
| | Conventional method No. 17 | Piercing pit corrosion | Yes | 17.0 | 30.0 |

According to Tables 12 through 15, it can be seen that, when treating by the inventive method, the characteristics of each member of the heat-exchanger all improve compared with those by conventional method. In particular, conspicuous improvement in the electrical conductivity is obvious.

Whereas, the fin materials obtained by comparative method have equal tensile strength, but have electrical conductivity improved not so much, when comparing with those by conventional method. Besides, the fin material treated by Comparative method No. 16 shows equal characteristics to those by the inventive method (Table 12 and Table 13), but, when treating the tube material under same conditions (Table 14 and Table 15), the corrosion resistance decreases in all cases, hence those conditions are unsuitable for the production of a heat-exchanger with these members combined.

EXAMPLE 5

From the tube materials J and K shown in Table 10, coil-shaped plate materials were produced by a conventional method, respectively, and said plate materials were slitted adjusting to the size of seam welded pipe to obtain 35.0 mm with strip materials. These strip materials were processed to 16.0 mm wide, 2.2 mm thick flat tubes for fluid-passing pipe using a device for producing seam welded pipe.

Moreover, 1 mm thick header plate materials L and M cladded with JIS 7072 alloy on one side of core material alloys f and g having the compositions shown in Table 9 at a cladding rate of 10% were produced. Namely, plate material L was produced from core material alloy f and plate material M from core material alloy g. And, after coil-shaped plate materials were produced from these plate materials, they were slitted to a width of 60 mm to obtain the strip materials for header plate.

Above-mentioned flat tubes (tube materials J and K), header plate materials (L and M) and aluminum alloy fin materials (E and F) shown in Table 8 were combined as in Table 17 to assemble the radiators shown in FIG. 1.

After coated with 10% concentration liquor of fluoride type flux onto the radiators assembled in this way, temperature was raised at 30° C./min in nitrogen gas, followed successively by heating under the conditions of 595° C. and 10 minutes to solder. Thereafter, cooling was made under the conditions shown in Table 16 and, of the radiators thus obtained, the thermal efficiency and the corrosion resistance were examined as follows.

The thermal efficiency was determined according to JIS D1618 (Test method of automobile air conditioner) and the proportion of improvement to the thermal efficiency of radiator produced by conventional method was indicated by percentage, the results of which are in Table 10. Moreover, for the corrosion resistance of these radiators, CASS test was carried out for 720 hours and the depth of pit corrosion generated in the flat tube was determined. Values of the maximum depth of pit corrosion are in Table 17. Besides, when the maximum depth of pit corrosion is less than 0.1 mm, the corrosion resistance can be said to be excellent.

TABLE 16

| Production method | No | Cooling velocity to retaining temperature (°C./min) | Retaining conditions Temperature (°C.) | Retaining conditions Time | Cooling velocity to room temperature (°C./min) |
|---|---|---|---|---|---|
| Inventive method | 18 | 10 | 480 | 2 hr | 50 |
| | 19 | 10 | 450 | 30 min | 100 |
| | 20 | 10 | 440 | 10 hr | 100 |
| | 21 | 10 | 490 | 2 hr | 1000° C./sec or faster |
| Comparative method | 22 | 10 | 300 | 30 min | 100 |
| | 23 | 10 | 450 | 30 min | 5 |
| | 24 | (No retainment) Cooled to room temperature at 100° C./min. | | | |
| Conventional method | 25 | (No retainment) Cooled to room temperature at 20° C./min. | | | |

TABLE 17

| Radiator No. | Symbol of member: Fin material | Tube material | Plate material | Production method | Improvement rate of thermal efficiency (%) | Max. depth of pit corrosion (mm) |
|---|---|---|---|---|---|---|
| 1 | E | J | L | Inventive method No. 18 | 2.0 | ≦0.05 |
| 2 | | | | Inventive method No. 19 | 2.5 | ≦0.05 |
| 3 | | | | Inventive method No. 20 | 2.5 | ≦0.05 |
| 4 | | | | Inventive method No. 21 | 2.0 | ≦0.05 |
| 5 | | | | Comparative method No. 22 | 0.5 | 0.2 |
| 6 | | | | Comparative method No. 23 | 2.5 | 0.2 |
| 7 | | | | Comparative method No. 24 | −0.5 | ≦0.05 |
| 8 | | | | Conventional method No. 25 | — | ≦0.05 |
| 9 | F | K | M | Inventive method No. 18 | 2.5 | ≦0.05 |
| 10 | | | | Inventive method No. 19 | 3.0 | ≦0.05 |
| 11 | | | | Inventive method No. 20 | 2.5 | ≦0.05 |
| 12 | | | | Inventive method No. 21 | 2.5 | ≦0.05 |
| 13 | | | | Comparative method No. 22 | 0.5 | Piercing pit corrosion |
| 14 | | | | Comparative method No. 23 | 2.5 | Piercing pit corrosion |
| 15 | | | | Comparative method No. 24 | −0.5 | ≦0.05 |
| 16 | | | | Conventional method No. 25 | — | Piercing pit corrosion |

According to Table 17, it can be seen that the radiators by the inventive method are excellent in both the thermal efficiency and the corrosion resistance. Whereas, it is seen that the radiators by comparative method are poor in both or either one of thermal efficiency and corrosion resistance.

EXAMPLE 6

Figure 3:
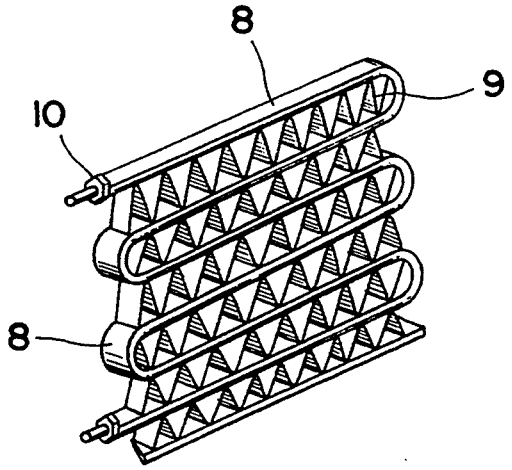
PRIOR ART Fig. 3
FIG. 3 is an oblique view showing a prior art serpentine type condenser.

After coated with chloride type flux onto extruded multihole tube produced from tube material G shown in Table 8 and fin materials H and I shown in Table 10, they were combined as in Table 18 to assemble the cores of serpentine type condenser shown in FIG. 3.

And, these cores were soldered by raising the temperature at 30° C./min in nitrogen gas and successively by heating under the conditions of 595° C. and 10 minutes similarly to Example 5. Thereafter, they were cooled under the conditions shown in Table 16 and, of the cores obtained, the thermal efficiency and the corrosion resistance were examined similarly to example 5.

TABLE 18

| Core No. | Symbol of member: Fin material | Tube material | Production method | Improvement rate of thermal efficiency (%) | Max. depth of pit corrosion (mm) |
|---|---|---|---|---|---|
| 1 | H | G | Inventive method No. 18 | 2.0 | ≦0.05 |
| 2 | | | Inventive method No. 19 | 2.5 | ≦0.05 |
| 3 | | | Inventive method No. 20 | 2.5 | ≦0.05 |
| 4 | | | Inventive method No. 21 | 2.0 | ≦0.05 |
| 5 | | | Comparative method No. 22 | 0.5 | 0.2 |
| 6 | | | Comparative method No. 23 | 2.5 | 0.2 |
| 7 | | | Comparative method No. 24 | −0.5 | ≦0.05 |
| 8 | | | Conventional method No. 25 | — | ≦0.05 |
| 9 | I | | Inventive method No. 18 | 1.5 | ≦0.05 |
| 10 | | | Inventive method No. 19 | 2.0 | ≦0.05 |
| 11 | | | Inventive method No. 20 | 2.0 | ≦0.05 |
| 12 | | | Inventive method No. 21 | 2.0 | ≦0.05 |
| 13 | | | Comparative method No. 22 | 0.5 | 0.2 |
| 14 | | | Comparative method No. 23 | 2.5 | 0.2 |
| 15 | | | Comparative method No. 24 | −0.5 | ≦0.05 |

TABLE 18-continued

| Core No. | Symbol of member: Fin material | Symbol of member: Tube material | Production method | Improvement rate of thermal efficiency (%) | Max. depth of pit corrosion (mm) |
|---|---|---|---|---|---|
| 16 | | | Conventional method No. 25 | — | ≦0.05 |

According to Table 18, it can be seen that the cores by the inventive method are excellent in both the thermal efficiency and the corrosion resistance, whereas those by comparative method are poor in both or either one of these characteristics.

U having respective compositions shown in Table 19 were produced by a conventional production method. The plate materials, were cladded with each 10% 4004 alloy on both sides thereof. These were submitted to soldering and the same heating and cooling in vacuum under the conditions shown in Table 20 to test. The combinations are shown in Tables 21 and 22. With the specimens of plate materials obtained, corrosion resistance test, tensile test and measurement of electrical conductivity were carried out, the results of which are shown in Table 22. Also, with those of fin materials, only tensile test and measurement of electrical conductivity were carried out, the results of which are shown in Table 21.

All of these test methods are same as the methods carried out in Example 4.

TABLE 19

| Alloy No. | Composition of alloy wt %: Si | Fe | Cu | Mn | Mg | Zn | Cr | Zr | Ti | Al | Name of alloy | Cladding |
|---|---|---|---|---|---|---|---|---|---|---|---|---|
| Fin material P | 0.23 | 0.45 | 0.06 | 1.11 | — | 1.12 | — | — | 0.01 | Balance | | Bare material |
| Fin material Q | 0.18 | 0.62 | — | — | — | 1.10 | — | 0.14 | 0.01 | " | | " |
| Fin material R | 0.42 | 0.55 | — | — | — | 1.12 | — | 0.15 | 0.01 | " | | " |
| Plate material S | 0.32 | 0.23 | 0.46 | 1.24 | — | — | — | — | 0.01 | " | | 10% 4004 on both sides |
| Plate material T | 0.20 | 0.51 | 0.13 | 1.10 | — | — | — | — | 0.01 | " | 3003 | 10% 4004 on both sides |
| Plate material U | 0.63 | 0.52 | 0.46 | 1.17 | 0.16 | — | 0.12 | 0.13 | 0.11 | " | | 10% 4004 on both sides |

EXAMPLE 7

Aluminum alloy fin materials (thickness 0.08 mm) P, Q and R and plate materials (thickness 0.6 mm) S, T and

TABLE 20

| | Treatment No. | Heating treatment for soldering | Cooling process |
|---|---|---|---|
| Inventive method | ① | Temperature-raising velocity 50° C./min. 600° C. × 5 min | Cooled to 480° C. at 10 ° C./min, retained for 2 hr at 480° C., and then cooled to room temperature at 50° C./min. |
| | ② | Same as above | Cooled to 410° C. at 10° C./min, retained for 30 min at 410° C., and then cooled to room temperature at 100° C./min. |
| | ③ | Same as above | Cooled to 450° C. at 10° C./min, retained for 18 hr at 450° C., and then cooled to room temperature at 100° C./min. |
| | ④ | Same as above | Cooled to 450° C. at 10° C./min, retained for 2 hr at 450° C., and then cooled with water (cooling velocity of 1000° C./sec or faster). |
| | ⑤ | Temperature-raising velocity 30° C./min. 595° C. × 10 min | Cooled to 480° C. at 10° C./min, retained for 2 hr at 480° C., and then cooled to room temperature at 50° C./min. |
| | ⑥ | Same as above | Cooled to 450° C. at 10° C./min, retained for 30 min at 450° C., and then cooled to room temperature at 100° C./min. |
| | ⑦ | Same as above | Cooled to 440° C. at 10° C./min, retained for 10 hr at 440° C., and then cooled to room temperature at 100° C./min. |
| | ⑧ | Same as above | Cooled to 490° C. at 10° C./min, retained for 2 hr at 490° C., and then cooled with water (cooling velocity of 1000° C./sec or faster). |
| Comparative method | ⑨ | Temperature-raising velocity 50° C./min. 600° C. × 5 min | Cooled to 300° C. at 10° C./min, retained for 30 min at 300° C., and then cooled to room temperature at 100° C./min. |
| | 10 | Same as above | Cooled to 450° C. at 10° C./min, retained for 30 min at 450° C., and then cooled to room temperature at 5° C./min. |
| | 11 | Same as above | Cooled to room temperature at 100° C./min. |
| | 12 | Temperature-raising velocity 30° C./min. 595° C. × 10 min | Cooled to 300° C. at 10° C./min, retained for 30 min at 300° C., and then cooled to room temperature at 100° C./min. |
| | 13 | Same as above | Cooled to 450° C. at 10° C./min, retained for 30 min at 450° C., and then cooled to room temperature at 5° C./min. |

TABLE 20-continued

| | Treatment No. | Heating treatment for soldering | Cooling process |
|---|---|---|---|
| Conventional method | 14 | Same as above | Cooled to room temperature at 100° C./min. |
| | 15 | Temperature-raising velocity 50° C./min. 600° C. × 5 min | Cooled to room temperature at 20° C./min. |
| | 16 | Temperature-raising velocity 30° C./min. 595° C. × 10 min | Cooled to room temperature at 20° C./min. |

TABLE 21

| | No. | Alloy No. | Treatment No. (See Table 20) | Tensile strength kgf/mm$^2$ | Electrical conductivity % IACS |
|---|---|---|---|---|---|
| Inventive material | 26 | Fin material P | ① | 12.5 | 45.0 |
| | 27 | | ② | 12.5 | 46.0 |
| | 28 | | ③ | 12.5 | 47.0 |
| | 29 | | ④ | 12.5 | 46.0 |
| Comparative material | 30 | | ⑨ | 12.0 | 38.0 |
| | 31 | | 10 | 12.0 | 46.0 |
| | 32 | | 11 | 12.5 | 35.0 |
| Conventional material | 33 | | 15 | 12.0 | 36.0 |
| Inventive material | 34 | Fin material Q | ① | 8.0 | 58.0 |
| | 35 | | ② | 8.0 | 59.0 |
| | 36 | | ③ | 8.0 | 59.5 |
| | 37 | | ④ | 8.0 | 58.0 |
| Comparative material | 38 | | ⑨ | 7.5 | 53.0 |
| | 39 | | 10 | 7.5 | 58.0 |
| | 40 | | 11 | 8.0 | 50.5 |
| Conventional material | 41 | | 15 | 7.5 | 51.0 |
| Inventive material | 42 | Fin material R | ① | 8.0 | 58.5 |
| | 43 | | ② | 8.0 | 59.0 |
| | 44 | | ③ | 8.0 | 58.5 |
| | 45 | | ④ | 8.0 | 58.5 |
| Comparative material | 46 | | ⑨ | 7.5 | 53.0 |
| | 47 | | 10 | 7.5 | 58.0 |
| | 48 | | 11 | 8.0 | 50.0 |
| Conventional material | 49 | | 15 | 7.5 | 50.0 |

TABLE 22

| | No. | Alloy No. | Treatment No. (See Table 20) | Max. depth of pit corrosion | Crystal boundary corrosion | Tensile strength kgf/mm$^2$ | Electrical conductivity % IACS |
|---|---|---|---|---|---|---|---|
| Inventive material | 50 | Plate material S | ① | 0.05 mm or less | No generation | 12.5 | 45.5 |
| | 51 | | ② | " | " | 12.5 | 47.0 |
| | 52 | | ③ | " | " | 12.5 | 47.0 |
| | 53 | | ④ | " | " | 12.5 | 46.5 |
| Comparative material | 54 | | ⑨ | 0.2 mm | Generation | 12.0 | 38.0 |
| | 55 | | 10 | " | " | 12.0 | 46.5 |
| | 56 | | 11 | 0.05 mm or less | No generation | 12.5 | 36.0 |
| Conventional material | 57 | | 15 | " | " | 12.0 | 36.5 |
| Inventive material | 58 | Plate material T | ① | " | " | 12.5 | 46.0 |
| | 59 | | ② | " | " | 12.5 | 47.0 |
| | 60 | | ③ | " | " | 12.5 | 48.0 |
| | 61 | | ④ | " | " | 12.5 | 47.0 |
| Comparative material | 62 | | ⑨ | 0.2 mm | Generation | 12.0 | 39.0 |
| | 63 | | 10 | " | " | 12.0 | 47.0 |
| | 64 | | 11 | 0.05 mm or less | No generation | 12.5 | 36.0 |
| Conventional material | 65 | | 15 | " | " | 12.0 | 37.0 |
| Inventive material | 66 | Plate material U | ① | " | " | 18.0 | 42.5 |
| | 67 | | ② | " | " | 18.0 | 43.0 |
| | 68 | | ③ | " | " | 18.0 | 44.0 |
| | 69 | | ④ | " | " | 18.0 | 43.0 |
| Comparative material | 70 | | ⑨ | Piercing pit corrosion | Generation | 17.0 | 34.5 |
| | 71 | | 10 | Piercing pit corrosion | " | 17.0 | 43.0 |
| | 72 | | 11 | 0.05 mm or less | No generation | 18.0 | 29.5 |
| Conventional material | 73 | | 15 | Piercing pit corrosion | Generation | 17.0 | 30.0 |

As evident from Table 21 and Table 22, when treating by the inventive method, the characteristics of fin material and plate material to become the members of heat-exchanger improve and, in particular, the electrical conductivity improves surely. Moreover, the treatment by Comparative method No. 10 brings about excellent characteristics for fin materials, but it decreases the corrosion resistance for plate materials in all cases, which is unsuitable for the production method of heat-exchanger compared with the inventive method.

EXAMPLE 8

Combining fin materials having the alloy compositions shown in Table 19 with plate materials having the alloy compositions similarly shown in Table 19, cores shown in FIG. 2 were assembled and soldered in vacuum under the conditions shown in Table 20. These combinations are shown in Table 23. Of the heat-exchangers thus obtained, the thermal efficiency and the corrosion resistance were examined, the results of which are shown in Table 23.

The thermal efficiency was determined according to JIS D1618 (Test method of automobile air conditioner) and the proportions of improvement to the thermal efficiency of heat-exchanger by conventional method were listed in Table 23, respectively. Moreover, for the corrosion resistance, CASS test was performed for 720 hours to determine the depth of pit corrosion generated in the plate, and the maximum depth of pit corrosion is shown in Table 23. The depth of less than 0.1 mm shows good corrosion resistance.

TABLE 23

| | No. | Alloy No. Fin material | Alloy No. Plate material | Treatment No. (See Table 20) | Thermal efficiency | Max. depth of pit corrosion |
|---|---|---|---|---|---|---|
| Inventive material | 74 | P | S | ⑤ | 2.0% Improvement | 0.05 mm or less |
| | 75 | | | ⑥ | 2.5% Improvement | " |
| | 76 | | | ⑦ | 2.5% Improvement | " |
| | 77 | | | ⑧ | 2.0% Improvement | " |
| Comparative material | 78 | | | 12 | 0.5% Improvement | 0.2 mm |
| | 79 | | | 13 | 2.5% Improvement | " |
| | 80 | | | 14 | 0.5% Decrease | 0.05 mm or less |
| Conventional material | 81 | | | 16 | Standard | " |
| Inventive material | 82 | Q | T | ⑤ | 1.5% Improvement | " |
| | 83 | | | ⑥ | 2.0% Improvement | " |
| | 84 | | | ⑦ | 2.0% Improvement | " |
| | 85 | | | ⑧ | 2.0% Improvement | " |
| Comparative material | 86 | | | 12 | 0.5% Improvement | 0.2 mm |
| | 87 | | | 13 | 2.0% Improvement | " |
| | 88 | | | 14 | 0.5% Decrease | 0.05 mm or less |
| Conventional material | 89 | | | 16 | Standard | " |
| Inventive material | 90 | R | U | ⑤ | 1.5% Improvement | " |
| | 91 | | | ⑥ | 2.0% Improvement | " |
| | 92 | | | ⑦ | 2.0% Improvement | " |
| | 93 | | | ⑧ | 2.0% Improvement | " |
| Comparative material | 94 | | | 12 | 0.5% Improvement | Generation of piercing pit corrosion |
| | 95 | | | 13 | 2.0% Improvement | Generation of piercing pit corrosion |
| | 96 | | | 14 | 0.5% Decrease | 0.05 mm or less |
| Conventional material | 97 | | | 16 | Standard | " |

As evident from Table 23, the Inventive examples No. 74 through 77, 82 through 85 and 90 through 93 being the heat-exchangers produced by the inventive method are excellent in the thermal efficiency and the corrosion resistance compared with Conventional examples No. 81, 89 and 97.

Whereas, with Comparative examples No. 78 through 80, 86 through 88 and 94 through 96 produced by comparative method, the improvement effect on thermal efficiency is not seen, and the corrosion resistance is seen to be rather decreased.

As described, in accordance with the invention, such conspicuous effects are exerted industrially that the thermal efficiency, strength and corrosion resistance of fin material, plate material, etc. being the members of aluminum alloy heat-exchanger improve, thereby the miniaturization and the lightening in weight of heat-exchanger become possible, and the like. Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of treating an aluminum alloy heat-exchanger produced by a brazing technique comprising:

cooling said aluminum alloy heat-exchanger to a temperature of 400° to 490° C. after brazing thereof;

retaining said aluminum alloy heat-exchanger at said temperature of 400° to 490° C. for a period of 10 minutes to 30 hours, wherein said retaining occurs during the step of cooling after brazing; and quickly cooling said aluminum alloy heat-exchanger at a rate which prevents deposition of at least one of Si, Mg-based compounds, and Cu-based compounds, across a temperature range of from 200°–400° C.

2. The method of treating said aluminum alloy heat-exchanger of claim 1, further comprising cooling said aluminum alloy heat-exchanger at a cooling velocity of not slower than 30° C./min across a temperature range of from 200° C. to 400° C. after the step of retaining.

3. The method of treating said aluminum alloy heat-exchanger of claim 1, wherein said soldering technique uses a flux.

4. The method of treating said aluminum alloy heat-exchanger of claim 1, wherein said soldering technique uses a potassium fluo-aluminate flux.

5. The method of treating said aluminum alloy heat-exchanger of claim 1, wherein a fin material of said aluminum alloy heat-exchanger includes:

an Al alloy;

said Al alloy includes 0.05–1.0 wt. % Si, 0.1–1.0 wt. % Fe, and 0.05–1.5 wt. % Mn;

at least one of the following:

not more than 0.5 wt. % Cu;
not more than 0.5 wt. % Mg;
not more than 0.3 wt. % Cr;
not more than 0.3 wt. % Zr;
not more than 0.3 wt. % Ti;
not more than 2.5 wt. % Zn;
not more than 0.3 wt. % In;
not more than 0.3 wt. % Sn; and
at least balance comprising essentially aluminum; and a brazing sheet using said Al alloy as a core material.

6. The method of treating said aluminum alloy heat-exchanger of claim 1, wherein a fin material of said aluminum alloy heat-exchanger includes:

an Al alloy;

said Al alloy includes 0.05–1.0 wt. % Si, 0.1–1.0 wt. % Fe, and 0.03–0.3 wt. % Zr;

not more than 0.5 wt. % Cu;
not more than 0.5 wt. % Mg;
not more than 0.3 wt. % Cr;
not more than 0.3 wt. % Ti;
not more than 2.5 wt. % Zn;
not more than 0.3 wt. % In;
not more than 0.3 wt. % Sn; and
at least balance comprising essentially aluminum; and a brazing sheet using said Al alloy as a core material.

7. The method of treating said aluminum alloy heat-exchanger of claim 1, wherein a pathway-constituting member for refrigerant of said aluminum alloy heat-exchanger includes:

an Al alloy;

said Al alloy includes 0.05–1.0 wt. % Si, and 0.1–1.0 wt. % Fe;

at least one of the following:

not more than 1.5 wt. % Mn;
not more than 1.0 wt. % Cu;
not more than 0.5 wt. % Mg;
not more than 0.3 wt. % Cr;
not more than 0.5 wt. % Zr;
not more than 0.3 wt. % Ti; and
at least balance comprising essentially aluminum; and a brazing sheet using said Al alloy as a core material.

8. The method of treating said aluminum alloy heat-exchanger of claim 1, wherein a fin of said aluminum alloy heat-exchanger is a bare material and a pathway of a refrigerant is a brazing sheet.

9. The method of treating said aluminum alloy heat-exchanger of claim 1, wherein a fin of said aluminum alloy heat-exchanger is a brazing sheet and a pathway of a refrigerant is a bare material.

10. The method of treating said aluminum alloy heat-exchanger of claim 1, wherein said soldering technique is a vacuum brazing technique.

11. The method of treating said aluminum alloy heat-exchanger of claim 10, wherein a soldering material is an Al-Si-Mg based Al alloy.

12. The method of treating said aluminum alloy heat-exchanger of claim 10, wherein a fin material of said aluminum alloy heat-exchanger includes:

an Al alloy;

said Al alloy includes 0.05–1.0 wt. % Si, 0.1–1.0 wt. % Fe, and 0.05–1.5 wt. % Mn;

at least one of the following:

not more than 0.5 wt. % Cu;
not more than 0.5 wt. % Mg;
not more than 0.3 wt. % Cr;
not more than 0.3 wt. % Zr;
not more than 0.3 wt. % Ti;
not more than 0.3 wt. % In;
not more than 0.3 wt. % Sn; and
at least balance comprising essentially aluminum; and a brazing sheet using said Al alloy as a core material.

13. The method of treating said aluminum alloy heat-exchanger of claim 10, wherein a fin material of said aluminum alloy heat-exchanger includes:

an Al alloy;

said Al alloy includes 0.05–1.0 wt. % Si, 0.1–1.0 wt. % Fe, and 0.03–0.3 wt. % Zr;

at least one of the following:

not more than 0.5 wt. % Cu;
not more than 0.5 wt. % Mg;
not more than 0.3 wt. % Cr;
not more than 0.3 wt. % Ti;
not more than 0.3 wt. % In;
not more than 0.3 wt. % Sn; and
at least balance comprising essentially aluminum; and a brazing sheet using said Al alloy as a core material.

14. A method of treating an aluminum alloy heat-exchanger comprising:

cooling said aluminum alloy heat-exchanger to 150° C. or lower after brazing thereof;

heating said aluminum alloy heat-exchanger to a prescribed temperature of 400° to 490° C.;

retaining said aluminum heat-exchanger at said prescribed temperature for a period of from 10 minutes to 30 hours; and quickly cooling said aluminum alloy heat-exchanger at a rate of 30° C./min., or more, across a temperature range of from 200°–400° C.

15. A method of producing an aluminum alloy heat-exchanger comprising:

soldering said aluminum alloy heat-exchanger with a soldering material consisting essentially of an Al-Si-Mg based Al alloy;

wherein said soldering technique uses a potassium fluo-aluminate flux;

cooling said aluminum alloy heat exchanger to 150° C. or less;

heating said aluminum alloy heat-exchanger to 400°–490° C. for 10 minutes to 30 hours; and cooling said aluminum alloy heat-exchanger at a rate of 30° C./min., or more, across a temperature range of from 200°–400° C.

* * * * *